US005611087A

United States Patent [19]

Adkins

[11] Patent Number: 5,611,087

[45] Date of Patent: Mar. 18, 1997

[54] SEPARABLE GARMENT

[76] Inventor: Lola Adkins, 1050 E. 224 St., Bronx, N.Y. 10466

[21] Appl. No.: 522,074

[22] Filed: Aug. 31, 1995

[51] Int. Cl.[6] ..... A41B 1/00

[52] U.S. Cl. ..... 2/114; 2/227; 2/913; 2/919

[58] Field of Search ..... 2/114, 113, 109, 2/104, 400, 908, 914, 913, 915, 916, 919, 115

[56] References Cited

U.S. PATENT DOCUMENTS

| | | | |
|---|---|---|---|
| 459,106 | 9/1891 | Fifield | 2/114 |
| 782,819 | 2/1905 | Bikle | 2/114 X |
| 818,351 | 4/1906 | Clark | 2/114 |
| 1,010,679 | 12/1911 | Padernacht | 2/104 X |
| 1,083,712 | 1/1914 | Uyeda | 2/408 |
| 1,462,515 | 7/1923 | McElroy | 2/114 X |
| 1,489,046 | 4/1924 | Thompson | 2/114 |
| 3,116,491 | 1/1964 | Previdi et al. | 2/114 X |
| 3,490,072 | 1/1970 | Keltner | 2/114 |
| 4,570,268 | 2/1986 | Freeman | 2/114 |
| 4,737,995 | 4/1988 | Wiley | 2/114 |
| 5,097,535 | 3/1992 | Dye et al. | 2/114 X |
| 5,315,716 | 5/1994 | Baum | 2/912 X |

*Primary Examiner*—C. D. Crowder
*Assistant Examiner*—Shirra L. Jenkins

[57] ABSTRACT

A garment for permitting ease of enclosing portions of a human body. The inventive device includes a front garment panel positionable over an anterior portion of a human body. A rear garment panel is positionable over a posterior portion of the human body and can be removably coupled at opposed lateral edges thereof to opposed lateral edges of the front garment panel to fully enclose the selected portion of the human body.

1 Claim, 3 Drawing Sheets

SEPARABLE GARMENT

BACKGROUND OF THE INVENTION

1. Field of the Invention

The present invention relates to garment structures and more particularly pertains to a separable garment for permitting ease of enclosing portions of a human body.

2. Description of the Prior Art

The use of garment structures is known in the prior art. More specifically, garment structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art garment structures include U.S. Pat. No. 4,644,589; U.S. Pat. No. 5,184,359; U.S. Pat. No. 4,764,985; U.S. Pat. No. 4,754,500; and U.S. Pat. No. 5,341,515.

While these devices fulfill their respective, particular objectives and requirements, the aforementioned patents do not disclose a separable garment for permitting ease of enclosing portions of a human body which includes a front garment panel positionable over an anterior portion of the human, and a rear garment panel positionable over a posterior portion of the human body which can be removably coupled to opposed lateral edges of the front garment panel to fully enclose the selected portion of the human body.

In these respects, the separable garment according to the present invention substantially departs from the conventional concepts and designs of the prior art, and in so doing provides an apparatus primarily developed for the purpose of permitting ease of enclosing portions of a human body.

SUMMARY OF THE INVENTION

In view of the foregoing disadvantages inherent in the known types of garment structures now present in the prior art, the present invention provides a new separable garment construction wherein the same can be utilized for easily enclosing portions of a human body. As such, the general purpose of the present invention, which will be described subsequently in greater detail, is to provide a new separable garment apparatus and method which has many of the advantages of the garment structures mentioned heretofore and many novel features that result in a separable garment which is not anticipated, rendered obvious, suggested, or even implied by any of the prior art garment structures, either alone or in any combination thereof.

To attain this, the present invention generally comprises a garment for permitting ease of enclosing portions of a human body. The inventive device includes a front garment panel positionable over an anterior portion of a human body. A rear garment panel is positionable over a posterior portion of the human body and can be removably coupled at opposed lateral edges thereof to opposed lateral edges of the front garment panel to fully enclose the selected portion of the human body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new separable garment apparatus and method which has many of the advantages of the garment structures mentioned heretofore and many novel features that result in a separable garment which is not anticipated, rendered obvious, suggested, or even implied by any of the prior art garment structures, either alone or in any combination thereof.

It is another object of the present invention to provide a new separable garment which may be easily and efficiently manufactured and marketed.

It is a further object of the present invention to provide a new separable garment which is of a durable and reliable construction.

An even further object of the present invention is to provide a new separable garment which is susceptible of a low cost of manufacture with regard to both materials and labor, and which accordingly is then susceptible of low prices of sale to the consuming public, thereby making such separable garments economically available to the buying public.

Still yet another object of the present invention is to provide a new separable garment which provides in the apparatuses and methods of the prior art some of the advantages thereof, while simultaneously overcoming some of the disadvantages normally associated therewith.

Still another object of the present invention is to provide a new separable garment for permitting ease of enclosing portions of a human body.

Yet another object of the present invention is to provide a new separable garment which includes a front garment panel positionable over an anterior portion of the human, and a rear garment panel positionable over a posterior portion of the human body which can be removably coupled to opposed lateral edges of the front garment panel to fully enclose the selected portion of the human body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
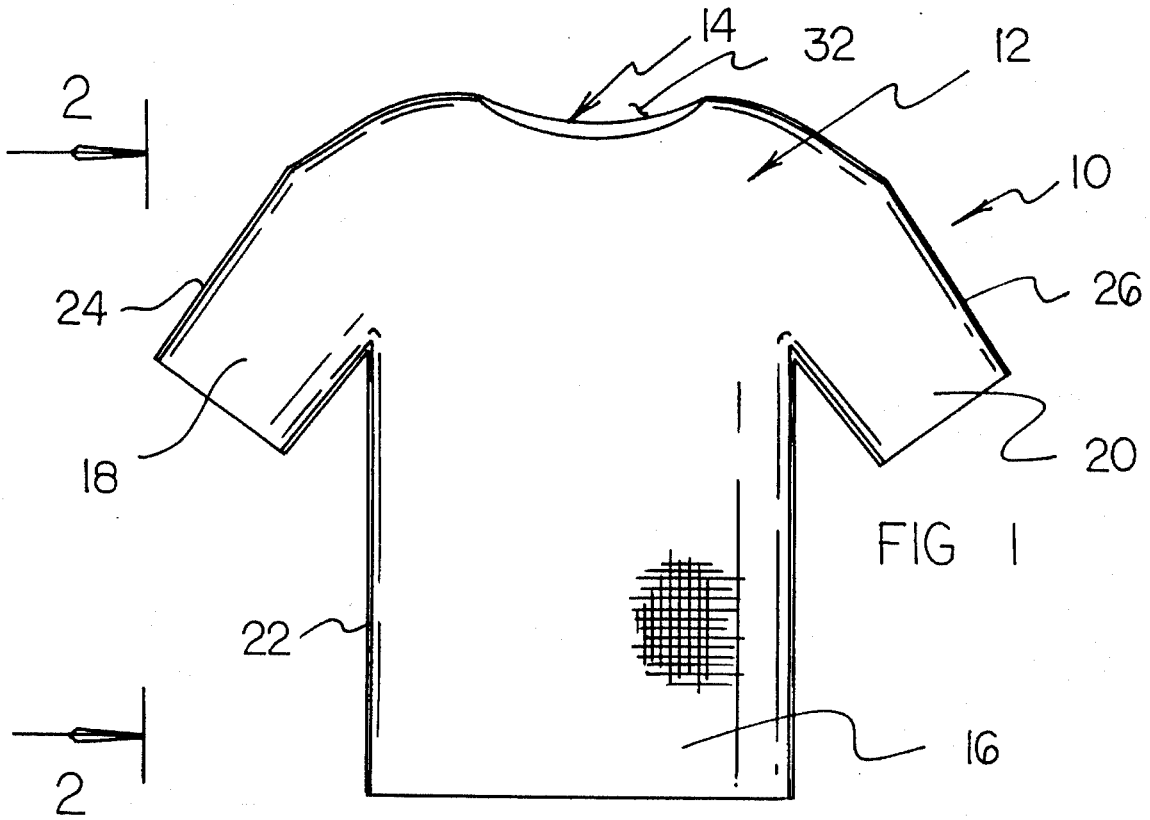
FIG. 1 is a front elevation view of a separable garment according to the present invention.

With reference now to the drawings, and in particular to FIGS. 1–6 thereof, a new separable garment embodying the principles and concepts of the present invention and generally designated by the reference numeral 10 will be described.

More specifically, it will be noted that the separable garment 10 comprises a front garment panel 12 positionable over an anterior portion of a human body. A rear garment panel 14 is positionable over a posterior portion of the human body and is removably coupled to the front garment panel 12 by securing means extending along laterally opposed sides of the garment panels 12 and 14. By this structure, the garment panels 12 and 14 can be individually positioned along opposed sides of a portion of the human body to be covered, whereby removable coupling of the securing means together will secure the garment 10 about such portions of the human body.

Figure 2:
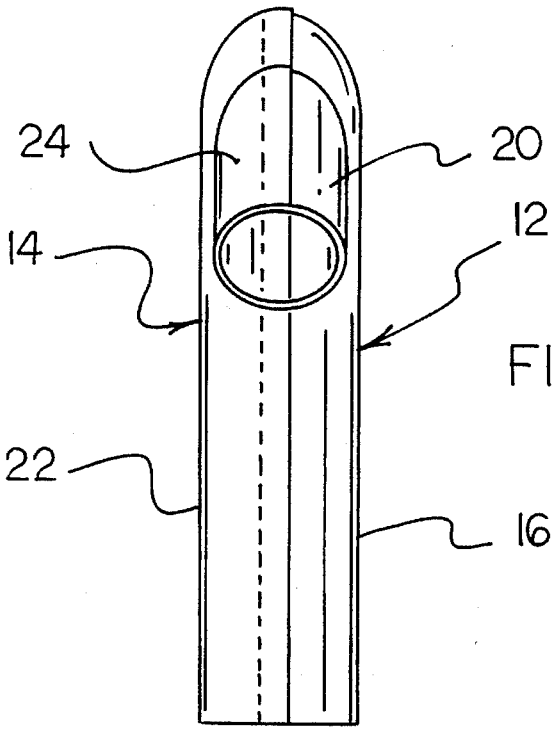
FIG. 2 is a side elevation view thereof taken from line 2—2 of FIG. 1.
Figure 3:
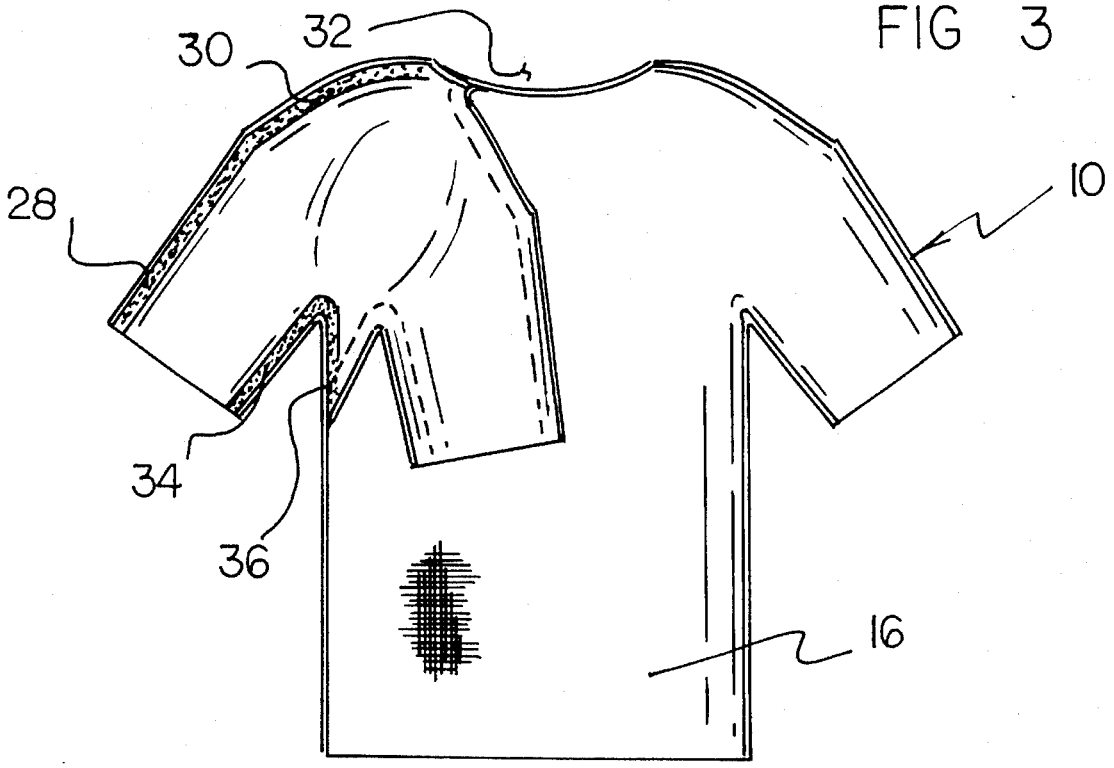
FIG. 3 is a front elevation view, partially exploded, of the invention.

Referring now to FIGS. 1 through 3 wherein the present invention 10 is illustrated in detail, it can be shown that the front garment panel 12 of the present invention 10 preferably comprises a front torso web 16 shaped so as to coextensively cover a torso portion of the human body. A front right arm web 18 extends from a first lateral side of the front torso web 16, with a front left arm web 20 extending from a second lateral side of the front torso web 16 to complete the front garment panel 12. The rear garment panel 14 similarly comprises a rear torso web 22 adapted to coextensively cover a posterior torso portion of a human body having a rear right arm web 24 projecting from a first side thereof and a rear left arm web 26 projecting from a second side thereof. By this structure, the garment panels 12 and 14 of the separable garment 10 are configured to the torso portion, the shoulder portion, and upper arm portions of a human body.

Referring now to FIG. 3, it can be shown that the securing means of the present invention 10 comprises an outer arm securing means 28 coupled to an outer longitudinal edge of the front and rear right arm webs 18 and 24. The outer arm securing means 28 also extends along an outer longitudinal edge of the front and rear left arm webs 20 and 26. The securing means further comprises a shoulder securing means 30 secured to upper edges of the front and rear torso webs 16 and 22. To permit passage of a neck of a human body through the upper end of the garment 10, the front and rear torso webs 16 and 22 are shaped so as to cooperatively define a neck aperture 32 directed therethrough. With continuing reference to FIG. 3, it can be shown that the securing means further comprises an inner arm securing means 34 extending along an inner longitudinal edge of the front and rear right arm webs 18 and 24, as well as along the inner longitudinal edges of the front and rear left arm webs 20 and 26. Further, the securing means additionally comprises torso securing means 36 extending along respectively opposed sides of both the front and rear torso webs 16 and 22 so as to removably couple the torso webs together at opposed longitudinal lateral sides thereof. By this structure, the front garment panel 12 can be removably coupled to the rear garment panel 14 about a select group of body parts of a human body to be covered.

The securing means 28, 30, 34, and 36 each preferably comprise cooperatively engagable elongated portions of hook and loop fabric fastening material such as is commonly known under the trademarked name "VELCRO" which are secured to the respective portions of the front and rear garment panels 12 and 14. The hook and loop fabric fastening material permits for ease of interconnecting of the garment panels 12 and 14 together even when misaligned relative to one another.

Figure 4:
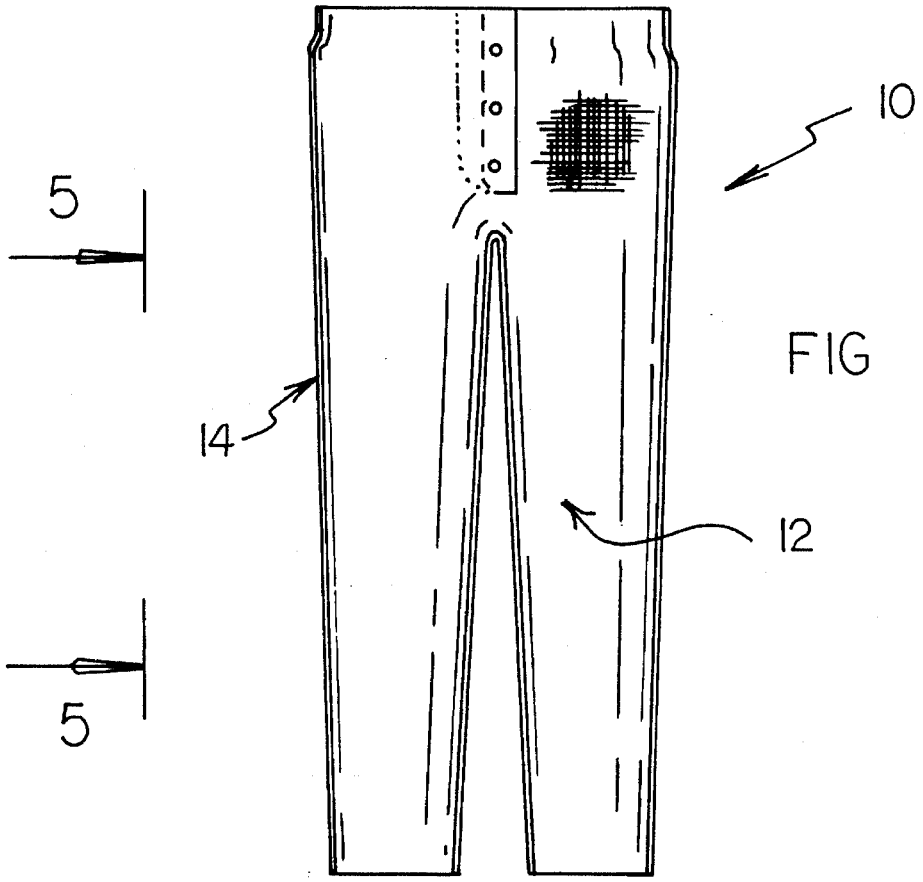
FIG. 4 is a front elevation view of an alternative form of the present invention.
Figure 5:
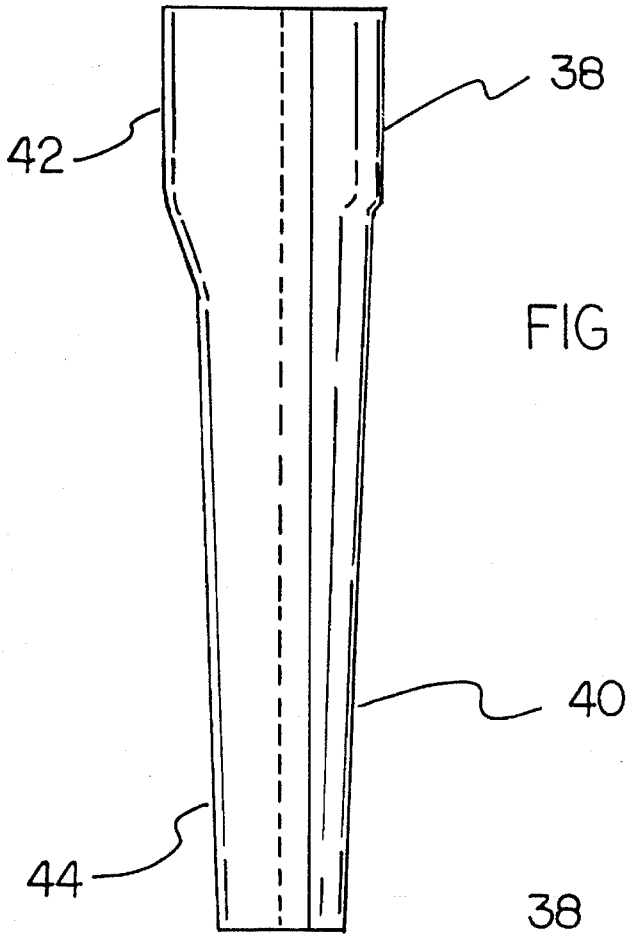
FIG. 5 is a side elevation view thereof taken from line 5—5 of FIG. 4.
Figure 6:
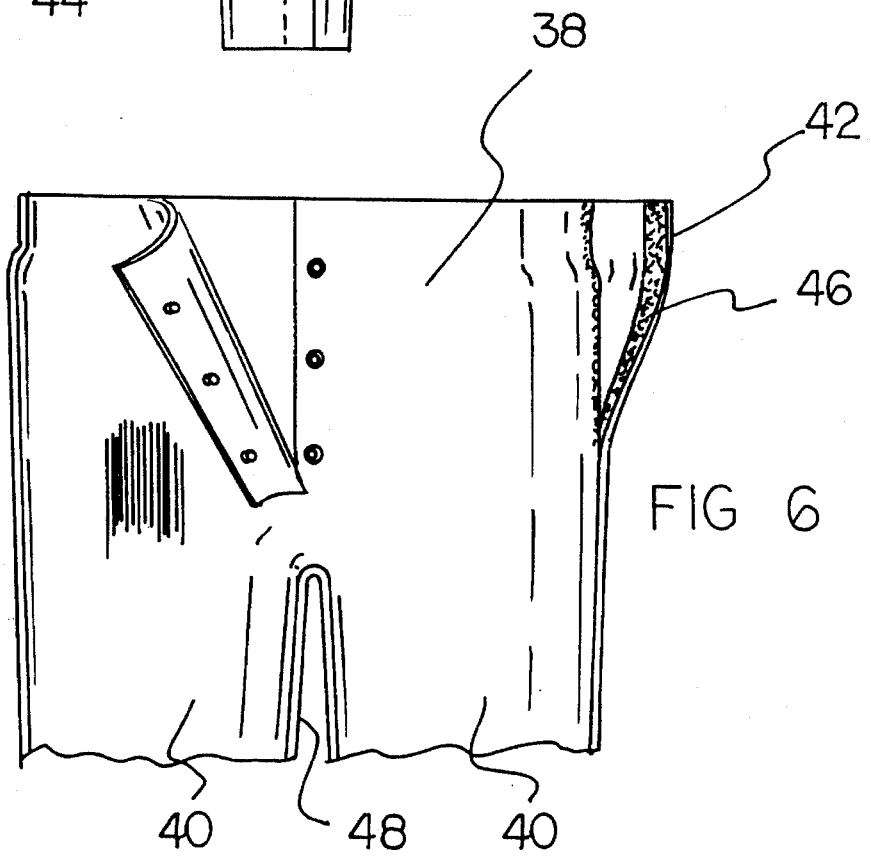
FIG. 6 is an enlarged elevation, partially exploded, of the alternative form of the present invention.

Referring now to FIGS. 4 through 6, it can be shown that the separable garment 10 of the present invention may take the form of a pair of pants wherein the front garment panel 12 comprises a front pelvis web 38 adapted to coextensively cover a pelvis portion of a human body. A pair of spaced elongated front leg webs 40 extend from the front pelvis web 38 and are adapted to cover anterior portions of human legs of the human body. Similarly, the rear garment panel 14 comprises a rear pelvis web 42 adapted to cover a posterior portion of a human pelvis, with rear leg webs 44 projecting in a substantially spaced and parallel orientation from the rear pelvis web 42. The securing means of the alterative form of the present invention 10 as shown in FIG. 6 includes lateral securing means 46 extending along respectively opposed outer longitudinal edges of the front and rear garment panels 12 and 14. In other words, the lateral securing means 46 extends along respectively opposed sides of the front and rear pelvis webs 38 and 42 and continues along outer longitudinal edges of the front and rear leg webs 40 and 44. Further, the securing means additionally comprises interior edge securing means 48 extending along interior longitudinal edges of each of the front and rear leg webs 40 and 44. As noted above for the first embodiment of the present invention 10, the securing means 46 and 48 preferably each comprise elongated strips of hook and loop fabric fastening material which sewn, adhesively, or otherwise coupled to the respective garment panels 12 and 14. By this structure, the alternative form of the separable garment 10 illustrated in FIGS. 4 through 6 can be easily assembled about pelvis and leg portions of a human body.

In use, the separable garment 10 of the present invention can be easily utilized by individuals having a limited ability to done conventionally known clothing structures. The present invention 10 allows an individual to be dressed while lying in a bed or other hospital support structure, thereby fully covering a patient.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A separable garment comprising:

a front garment panel positionable over an anterior portion of a human being and a rear garment panel positionable over a posterior portion of the human body, the front garment panel comprises a front torso web shaped so as to coextensively cover a torso portion of a human body, a front right arm web extending from a first lateral side of the front torso web, and a front left arm web extending from a second lateral side of the front torso web, and further wherein the rear garment panel comprises a rear torso web shaped so as to coextensively cover a torso portion of the human body, a rear right arm web extending from a first lateral side of the rear torso web, and a rear left arm web extending from a second lateral side of the rear torso web, the front and rear torso webs being shaped so as to cooperatively define a neck aperture directed therethrough to permit passage of a neck of a human body through the upper end of the garment, an outer arm securing means extending along an outer longitudinal edge of the front and rear left arm webs, a shoulder securing means secured to upper edges of the front and rear torso webs, an inner arm securing means extending along an inner longitudinal edge of the front and rear right arm webs and along the inner longitudinal edges of the front and rear left arm webs, torso securing means extending along respectively opposed sides of both the front and rear torso webs each of said outer arms, shoulder, inner arm and torso securing means for removably coupling the torso webs together, the front garment panel comprises a front pelvis web shaped so as to coextensively cover a pelvis portion of a human body, a pair of spaced elongated front leg webs extending from the front pelvis web and shaped so as to cover anterior portions of human legs of the human body, the rear garment panel comprises a rear pelvis web shaped so as to cover a posterior portion of a human pelvis, a pair of spaced and elongated rear leg webs projecting from the rear pelvis web and shaped so as to cover posterior portions of the human legs of the human body, lateral securing means extending along respectively opposed outer longitudinal edges of the front and rear garment panels, the lateral securing means extending along respectively opposed sides of the front and rear pelvis webs and continues along outer longitudinal edges of the front and rear legs webs, interior edge securing means extending along interior longitudinal edges of each of the front and rear leg webs, each of said lateral and interior edge securing means for removably coupling the pelvis webs together.

* * * * *